United States Patent [19]

Harada et al.

[11] 4,204,483

[45] May 27, 1980

[54] FUEL CUT-OFF APPARATUS FOR ELECTRONICALLY-CONTROLLED FUEL INJECTION SYSTEMS

[75] Inventors: Susumu Harada, Oobu; Toshio Kondo, Anjo; Tomomi Eino, Kariya, all of Japan

[73] Assignee: Nippondenso Co., Ltd., Kariya, Japan

[21] Appl. No.: 923,306

[22] Filed: Jul. 10, 1978

[30] Foreign Application Priority Data

Jul. 15, 1977 [JP] Japan ..... 52-85465

[51] Int. Cl.[2] ..... F02B 3/00

[52] U.S. Cl. ..... 123/32 EL; 123/97 B

[58] Field of Search ..... 123/32 EL, 97 B, 102, 123/198 DB, 32 EE, DIG. 11; 60/285

[56] References Cited

U.S. PATENT DOCUMENTS

| | | | |
|---|---|---|---|
| 3,719,176 | 3/1973 | Shinoda et al. | 123/32 EL |
| 3,731,659 | 5/1973 | Barr et al. | 123/32 EL |
| 3,735,742 | 5/1973 | Aono et al. | 123/32 EL |
| 3,753,427 | 8/1973 | Cedar | 123/DIG. 11 |
| 4,029,061 | 6/1977 | Asano | 60/285 |
| 4,064,844 | 12/1977 | Matsumotdo et al. | 123/32 EL |
| 4,073,269 | 2/1978 | Herth et al. | 123/32 EE |
| 4,083,267 | 4/1978 | Raaz | 123/102 |
| 4,094,274 | 6/1978 | Harada et al. | 123/198 DB |
| 4,126,107 | 11/1978 | Harada et al. | 123/32 EL |
| 4,129,109 | 12/1978 | Matsumoto | 123/32 EL |
| 4,148,283 | 4/1979 | Harada et al. | 123/32 EL |
| 4,159,701 | 7/1979 | Murata | 123/97 B |

*Primary Examiner*—Charles J. Myhre
*Assistant Examiner*—R. A. Nelli
*Attorney, Agent, or Firm*—Cushman, Darby & Cushman

[57] ABSTRACT

A fuel cut-off apparatus is used with an electronically-controlled fuel injection system of the type in which metering of fuel in accordance with the operating conditions of an engine is controlled by the pulse time width of an injection pulse signal applied to electromagnetic fuel injectors. The fuel cut-off apparatus includes a delay circuit, whereby when a fuel cut-off condition is attained during deceleration periods of the engine, the fuel supply to the engine is cut-off after a predetermined time delay.

3 Claims, 2 Drawing Figures

FUEL CUT-OFF APPARATUS FOR ELECTRONICALLY-CONTROLLED FUEL INJECTION SYSTEMS

BACKGROUND OF THE INVENTION

The invention relates to a fuel cut-off apparatus for electronically-controlled fuel injection system of internal combustion engines, which is designed to cut off the fuel supply to an engine during engine deceleration so as to prevent deterioration of the vehicle driving feeling.

Known apparatus of the above type are designed so that the supply of fuel to an engine is cut off immediately in response to a fuel cut-off condition where the opening of the engine throttle valve is smaller than a predetermined value and the engine rpm is higher than a predetermined value. A disadvantage of this type of the known apparatus is that there occurs a great difference between the engine output torque during the injection of fuel and the engine output torque at the instant that the fuel injection is stopped, thus causing shock to the vehicle upon fuel cut off as compared with those having engines which do not cut off the fuel supply. Thus, while this fuel cut-off has the advantages of reduced fuel consumption and improved engine braking effect in addition to a great advantage of preventing a rise in the temperature of a catalyst in the case of vehicles in which an exhaust gas purifying catalyst is installed, there still exists the previously mentioned disadvantage of causing shock to a vehicle. To overcome these deficiencies, it has heretofore been the practice with the known apparatus to accomplish the fuel cut-off within a limited range of engine operating conditions.

SUMMARY OF THE INVENTION

With a view to overcoming the foregoing deficiencies, it is the object of this invention to provide a fuel cut-off apparatus wherein when a fuel cut-off condition occurs during deceleration operation of an engine, instead of immediately cutting off the supply of fuel, the fuel supply is cut off after a predetermined delay from the time of occurrence of the fuel cut-off condition or after the expiration of a time corresponding to a preset number of injections, whereby the torque of the vehicle having the engine subjected to fuel cut-off operation is reduced smoothly to eliminate shock to the vehicle and thereby to increase the range of the fuel cut-off condition.

DESCRIPTION OF THE PREFERRED EMBODIMENT

The present invention will now be described in greater detail with reference to the illustrated embodiment.

Figure 1:
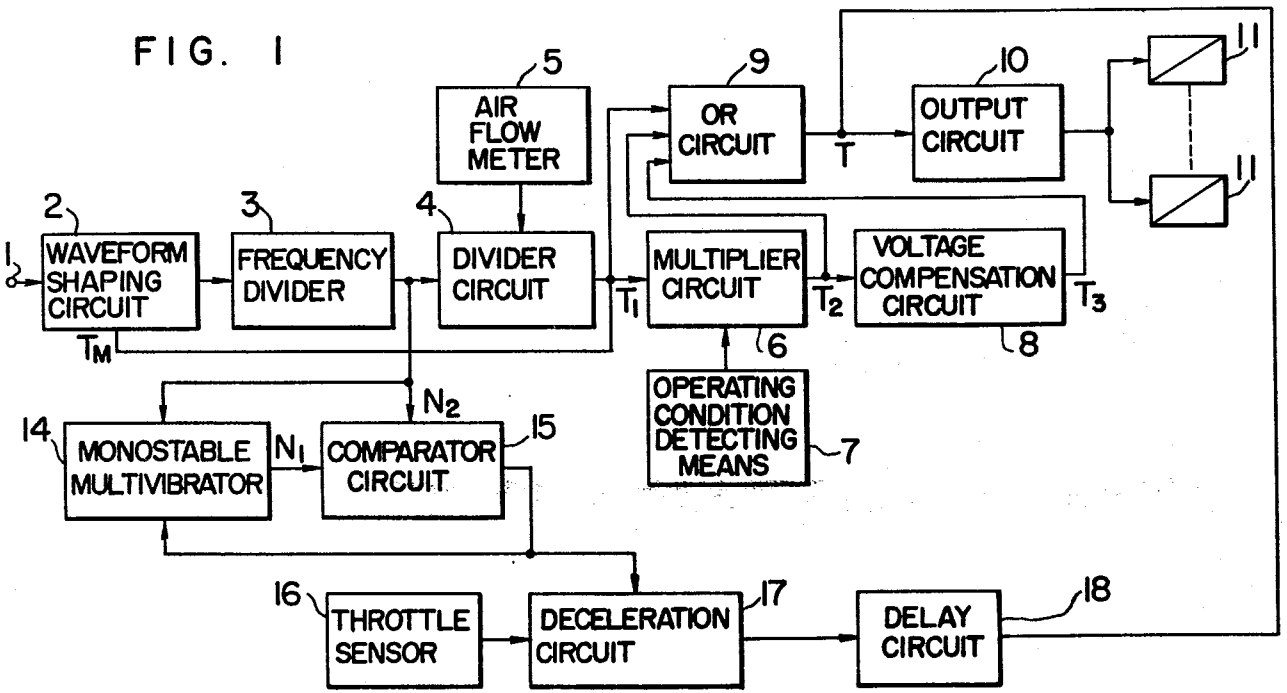
FIG. 1 is a block diagram showing the overall construction of an embodiment of the present invention.

Referring to FIG. 1 illustrating the overall construction of the apparatus according to the invention, numeral 1 designates the primary terminal of an ignition coil which is not shown for detecting, in the form of pulse signal, the speed signal of the engine, and 2 a waveform shaping circuit adapted to shape the waveform of the pulse signal for preventing erroneous operation and also serving the function of generating a pulse signal $T_M$ of a preset pulse width in synchronism with a pulse signal $T_1$ which will be described later so as to prevent the time width of the pulse signal $T_l$ from exceeding a predetermined value. Numeral 3 designates a frequency divider circuit which must of course be a 3:1 frequency divider in the case of a six-cylinder engine in which the number of times of fuel injection is 1 per engine revolution or any other suitable frequency divider in cases where the number of times of fuel injection is more than 2 for every engine revolution or 1 for every two engine revolutions. Numeral 4 designates a divider circuit for receiving the speed signal from the frequency divider circuit 3 whose time width is inversely proportional to the engine rpm and the signal generated from an air flow meter 5 disposed upstream of the throttle valve of the engine and indicative of the amount of air flow to the engine so as to generate a pulse signal $T_l$ of a time width $t_p$ obtained by dividing the amount of air flow to the engine by the engine rpm. The time width $t_p$ is proportional to the amount of air drawn into cyclinder during one stroke, and the AND operation is performed on the pulse signals $T_M$ and $T_l$ to prevent the time width $t_p$ from exceeding the time width of the pulse signal $T_M$. Numeral 6 designates a multiplier circuit wherein the time width $t_p$ of the pulse signal $T_l$ generated from the divider circuit 4 and the output signals of operating condition detecting means 7 for detecting engine cooling water temperature, intake air temperature, etc., are multiplied together to generate a pulse signal $T_2$ of a time width $t_m$. Numeral 8 designates a voltage compensation circuit for receiving the pulse signal $T_2$ from the multiplier circuit 6 to generate a pulse signal $T_3$ of a time width $t_u$ corresponding to the supply voltage so as to compensate the amount of fuel injected from electromagnetic injectors 11 for variations in the supply voltage. Numeral 9 designates an OR circuit for receiving the pulse signals $T_1$, $T_2$ and $T_3$ from the divider circuit 4, the multiplier circuit 6 and the voltage compensation circuit 8 to supply to an output circuit 10 a pulse signal T of a time width $(t_p+t_m+t_u)$ and thereby to open the electromagnetic injectors 11. The electromagnetic injectors 11 are each so constructed that fuel under the predetermined pressure is supplied to the engine during the time that the injector is open.

The fuel injection system of the construction described above is known in the art as, for example, disclosed in U.S. Pat. No. 3,898,964.

Referring again to FIG. 1, the frequency divider circuit 3 is connected to a monostable multivibrator circuit 14 and a comparator circuit 15, and the comparator circuit 15 compares the pulse signal $N_2$ applied from the frequency divider circuit 3 and having a time width inversely proportional to the engine rpm and the pulse signal $N_1$ applied from the monostable multivibrator 14 in synchronism with the pulse signal $N_2$ and having a predetermined time width whereby generating a voltage which goes to "0" when the time width of the pulse signal $N_2$ is greater than the time width of the pulse signal $N_1$ and which goes to "1" when the time width of the pulse signal $N_2$ is smaller than the time width of the pulse signal $N_1$, and the output of the comparator circuit 15 is fed back to the monostable multivibrator 14 to cause the time width of the pulse signal $N_1$ to exhibit hysteresis. Of course, the predetermined time width of the pulse signal $N_1$ must be determined in accordance with a preset rpm value which is one condition for cutting off the fuel supply, and the comparator circuit 15 generates a "1" voltage only when the engine rpm is higher than a predetermined value or the time width of the pulse signal $N_2$ is less than the time width of the pulse signal $N_1$. Numeral 16 designates a throttle sensor operatively associated with the throttle valve of the engine and designed so that a "1" voltage is generated only when the throttle opening is less than a predetermined value which is around the fully-closed throttle position. Numeral 17 designates a deceleration detection circuit including a NAND gate, whereby a "0" voltage or injection cut-off signal is generated when the input signals from the comparator circuit 15 and the throttle sensor 16 are both "1" voltage, that is, during engine deceleration operation with the engine rpm being higher than the predetermined value and the throttle opening being less than the predetermined value. Numeral 18 designates a delay circuit whereby at the expiration of a predetermined time after the transition of the output voltage of the deceleration detection circuit 17 from "1" to "0", a "0" voltage is generated thus interrupting the application of the pulse signal T to the output circuit 10 from the OR circuit 9 and thereby cutting off the injection of fuel from the electromagnetic injectors 11.

Figure 2:
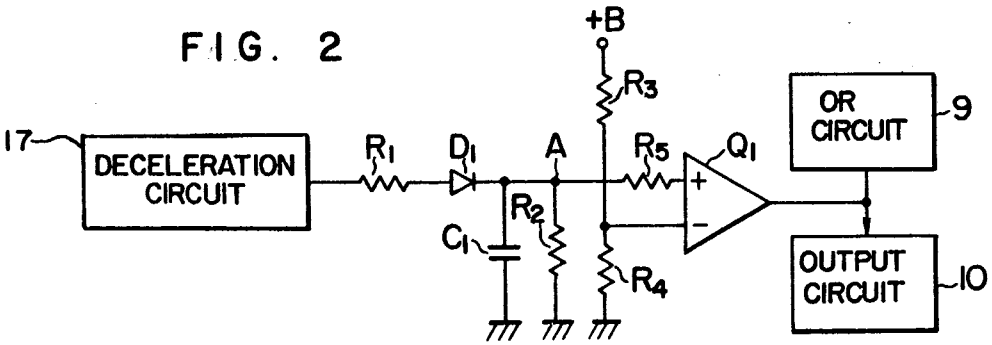
FIG. 2 is a circuit diagram of the delay circuit shown in FIG. 1.

Next, the circuit construction and operation of the delay circuit 18 constituting a principal part of the invention will be described in detail with reference to FIG. 2. The delay circuit 18 comprises resistors $R_1$ to $R_5$, a capacitor $C_1$, a diode $D_1$ and a comparator $Q_1$. In operation, when the output voltage of the deceleration detection circuit 17 is "1" indicating that the engine is not under deceleration operation, due to a small resistance value of the resistor $R_1$, the capacitor $C_1$ is instantaneously charged so that the potential at a point A becomes higher than a predetermined comparison voltage dependent on the resistors $R_3$ and $R_4$ (this comparison voltage is lower than the "1" voltage and higher than the "0" voltage) and the output voltage of the comparator $Q_1$ goes to "1". On the other hand, when the output voltage of the deceleration detection circuit 17 goes to "0" indicating that the engine is under deceleration operation, the charge stored in the capacitor $C_1$ is prevented from flowing to the deceleration detection circuit 17 by the diode $D_1$ and the charge is discharged gradually through the resistor $R_2$ having a large resistance value so that the output voltage of the comparator $Q_1$ changes to "0" only after the expiration of a predetermined time necessary for the noninverting (+) input voltage of the comparator $Q_1$ to become lower than the inverting (−) input voltage (i.e., the comparison voltage determined by the resistor $R_3$ and $R_4$).

As a result, when there occurs a fuel cut-off condition under deceleration operation with the engine rpm being higher than the predetermined value and the throttle opening being lower than the predetermined value, only after the expiration of the predetermined time after the generation of a "0" voltage or fuel cut-off voltage from the deceleration detection circuit 17, the delay circuit 18 generates a "0"voltage so that the application of the fuel injection pulse signal T to the output circuit 10 from the OR circuit 9 is interrupted and the fuel injection is stopped. As a result, immediately after the deceleration the throttle valve is practically in the fully-closed position, the amount of air flow to the engine is reduced and the time width of the fuel injection pulse signal T is reduced thus decreasing the output torque of the engine as compared with that just before the deceleration, and thereafter the fuel supply is cut off to reduce the engine output torque to zero and thereby to prevent the application of shock to the vehicle by the cutting off of the fuel supply to the engine. After the supply of fuel to the engine has been cut off, when the engine rpm becomes lower than the predetermined value or when the throttle opening becomes greater than the predetermined value, the output voltage of the deceleration detection circuit 17 goes to "1". Consequently, as soon as the engine comes out of the deceleration operation, the electromagnetic injectors 11 are allowed to operate in response to the pulse signal T generated from the OR circuit 9.

The predetermined time interval of the delay circuit 18 can be preset to any desired value by suitably selecting the capacitor $C_1$ and the resistor $R_2$ or the comparison voltage (the resistors $R_3$ and $R_4$) of the comparator $Q_1$. The delay circuit 18 may also be one by which fuel cut-off is delayed by a time interval corresponding to a predetermined number of injection pulses (the number of times of injection) immediately after the engine has come into deceleration operation, and in this case it is only necessary to arrange so that when the deceleration detection circuit 17 generates a "0" voltage, the supply of fuel to the engine is cut off after a predetermined number of pulse signals synchronized with the injection pulses (i.e., the engine speed) from the frequency divider circuit 3, for example, has been counted.

It will thus be seen that with the fuel cut-off apparatus according to the invention, under fuel cut-off condition upon deceleration of the engine, the supply of fuel to the engine can be cut off without causing shock to the vehicle thus eliminating any deterioration of the vehicle driving feeling, and moreover the elimination of shock to the vehicle has the effect of increasing the range of the fuel cut-off condition and also the effect of decreasing fuel consumption, increasing engine braking effect or preventing increase in the temperature of an exhaust gas purifying catalyst.

We claim:

1. In an electronically-controlled fuel injection system for a combustion engine, said fuel injection system having first means responsive to the operating condition of said combustion engine and effective to produce electric condition signals indicative of said operating conditions, second means responsive to said electric condition signals and effective to produce an electric pulse signal having a time interval dependent on said operating conditions, and third means responsive to said electric pulse signal and effective to supply said combustion engine with pressurized fuel during said time interval, a fuel cut-off apparatus comprising:

deceleration detecting means responsive to the deceleration of said combustion engine for producing an electric deceleration signal indicative of said deceleration;

delay means responsive to said electric deceleration signal for producing an electric delay signal delayed in time relative to said electric deceleration signal, the interval of delay being sufficient to allow said second means to produce said electric pulse at least once; and preventing means responsive to said electric delay signal for preventing the fuel supply operation of said third means in synchronized relation with said electric delay signal.

2. A fuel cut-off apparatus according to claim 1, wherein said delay means includes:

time setting means for setting a constant time interval such that said electric delay signal is delayed relative to said electric deceleration signal by a time interval equal to said constant time interval.

3. A fuel cut-off apparatus according to claim 1, wherein said delay means includes:

rotation number setting means for setting a constant rotation number such that said electric delay signal is delayed relative to said electric deceleration signal by a time interval in which said combustion engine attains said constant rotation number.

* * * * *